US009016024B1

(12) United States Patent
Daudet

(10) Patent No.: US 9,016,024 B1
(45) Date of Patent: Apr. 28, 2015

(54) STEEL FRAMING CLIP

(71) Applicant: Larry Randall Daudet, Brentwood, CA (US)

(72) Inventor: Larry Randall Daudet, Brentwood, CA (US)

(73) Assignee: Simpson Strong-Tie Company, Pleasanton, CA (US)

( * ) Notice: Subject to any disclaimer, the term of this patent is extended or adjusted under 35 U.S.C. 154(b) by 0 days.

(21) Appl. No.: 14/092,744

(22) Filed: Nov. 27, 2013

(51) Int. Cl.
*E04H 12/00* (2006.01)
*E04B 1/24* (2006.01)

(52) U.S. Cl.
CPC ..... *E04B 1/2403* (2013.01)

(58) Field of Classification Search
USPC ..... 52/655.1, 643, 696
See application file for complete search history.

(56) References Cited

U.S. PATENT DOCUMENTS

| | | | |
|---|---|---|---|
| 529,154 | A | 11/1894 | Banks |
| 719,191 | A | 1/1903 | Collins |
| 992,941 | A | 5/1911 | Danielson |
| 1,101,745 | A | 6/1914 | Jones |
| 1,346,426 | A | 7/1920 | Sherbner |
| 1,791,197 | A | 2/1931 | Dickson |
| 2,873,828 | A | 2/1959 | Zitomer |
| 2,900,677 | A | 8/1959 | Yetter |
| 2,905,426 | A | 9/1959 | Ross |
| 2,918,995 | A | 12/1959 | Kruger |
| 3,083,794 | A | 4/1963 | Stovail |
| 3,126,928 | A | 3/1964 | McMillan |
| 3,299,839 | A | 1/1967 | Nordbak |
| 3,322,447 | A | 5/1967 | Biggs |
| 3,482,369 | A | 12/1969 | Burke |
| 3,490,604 | A | 1/1970 | Klein |
| 3,606,227 | A | 9/1971 | Klein |
| 3,653,172 | A | 4/1972 | Schwartz |
| 3,778,952 | A | 12/1973 | Soucy |
| 3,858,988 | A | 1/1975 | Cohen |
| 3,897,163 | A | 7/1975 | Holmes |
| 4,018,020 | A | 4/1977 | Sauer et al. |
| 4,027,453 | A | 6/1977 | Bridge |
| 4,043,689 | A | 8/1977 | Spencer |
| 4,075,810 | A | 2/1978 | Zakrzewski et al. |

(Continued)

OTHER PUBLICATIONS

Bailey Metal Products, "Deflection Connectors—Clips, Technical and Structural Information", Oct. 2009, pp. 12, 13, cover and back, Bailey Metal Products Limited, Canada.

(Continued)

*Primary Examiner* — Basil Katcheves
(74) *Attorney, Agent, or Firm* — James R. Cypher; Charles R. Cypher

(57) ABSTRACT

A multipurpose connector that minimally occludes the opening in a conventional steel wall stud when used to connect a conventional bridging member to the wall stud, conserving the opening's function as a pass-through for pipes, conduits and wiring. It has a tapering extension on one flange that maximizes its interface with a bridging member, and a matching central portion on the other flange that minimizes material waste when the connectors are cut from a roll of sheet metal on a progressive die machine. It has a pair of tapering tabs that maximize the functional interface with a wall stud and maximize the functional size of the opening in the wall stud. It has a plurality of fastener openings designed to permit a variety of secure connections to be made with the same fastener and a plurality of fasteners. It is one of a plurality of multipurpose connectors of different widths that can all be made on the same progressive die production line with minimal setup changes.

20 Claims, 11 Drawing Sheets

(56) References Cited

U.S. PATENT DOCUMENTS

| | | | | |
|---|---|---|---|---|
| 4,128,979 | A | 12/1978 | Price | |
| 4,140,417 | A | 2/1979 | Danielsen et al. | |
| 4,174,911 | A | 11/1979 | Maccario et al. | |
| 4,208,851 | A | 6/1980 | Sauer | |
| 4,235,054 | A | 11/1980 | Cable et al. | |
| 4,246,736 | A | 1/1981 | Kovar et al. | |
| 4,406,374 | A | 9/1983 | Yedor | |
| 4,426,822 | A | 1/1984 | Gailey | |
| 4,428,172 | A | 1/1984 | Larsson | |
| 4,448,004 | A | 5/1984 | Thorsell | |
| 4,464,074 | A | 8/1984 | Green | |
| 4,516,874 | A | 5/1985 | Yang et al. | |
| 4,522,009 | A | 6/1985 | Fingerson | |
| 4,586,841 | A | 5/1986 | Hunter | |
| 4,625,415 | A | 12/1986 | Diamontis | |
| 4,693,047 | A | 9/1987 | Menchetti | |
| 4,791,766 | A | 12/1988 | Egri | |
| 4,809,476 | A | 3/1989 | Satchell | |
| 4,840,005 | A | 6/1989 | Cochrane | |
| 4,850,169 | A | 7/1989 | Burkstrand et al. | |
| 4,858,407 | A | 8/1989 | Smolik | |
| 4,864,791 | A | 9/1989 | Platt | |
| 4,912,894 | A | 4/1990 | Platt | |
| 4,914,878 | A | 4/1990 | Tamaki et al. | |
| 4,916,877 | A | 4/1990 | Platt | |
| 4,951,436 | A | 8/1990 | Burkstrand et al. | |
| 5,092,100 | A | 3/1992 | Lambert et al. | |
| 5,127,760 | A | 7/1992 | Brady | |
| 5,155,962 | A | 10/1992 | Burkstrand et al. | |
| 5,189,857 | A | 3/1993 | Herren | |
| 5,253,465 | A * | 10/1993 | Gilb | 52/643 |
| 5,274,973 | A | 1/1994 | Liang | |
| 5,287,664 | A | 2/1994 | Schiller | |
| 5,325,651 | A | 7/1994 | Meyer et al. | |
| 5,363,622 | A | 11/1994 | Sauer | |
| 2,365,501 | A | 12/1994 | Walstrom | |
| 5,403,110 | A | 4/1995 | Sammann | |
| 5,446,969 | A | 9/1995 | Terenzoni | |
| 5,600,926 | A | 2/1997 | Ehrlich | |
| 5,605,024 | A | 2/1997 | Sucato et al. | |
| 5,632,128 | A | 5/1997 | Agar | |
| 5,664,392 | A | 9/1997 | Mucha | |
| 5,669,198 | A | 9/1997 | Ruff | |
| 5,671,580 | A | 9/1997 | Chou | |
| 5,682,935 | A | 11/1997 | Bustamante | |
| 5,697,725 | A | 12/1997 | Ballash et al. | |
| 5,720,138 | A | 2/1998 | Johnson | |
| 5,784,850 | A | 7/1998 | Elderson | |
| 5,876,006 | A | 3/1999 | Sharp | |
| 5,899,041 | A | 5/1999 | Durin | |
| 5,904,023 | A * | 5/1999 | diGirolamo et al. | 52/712 |
| 5,921,411 | A | 7/1999 | Merl | |
| 5,943,838 | A | 8/1999 | Madsen | |
| 5,964,071 | A | 10/1999 | Sato | |
| 6,021,618 | A | 2/2000 | Elderson | |
| 6,164,028 | A | 12/2000 | Hughes | |
| 6,199,336 | B1 | 3/2001 | Poliquin | |
| 6,242,698 | B1 | 6/2001 | Baker, III et al. | |
| 6,260,318 | B1 | 7/2001 | Herren | |
| 6,290,214 | B1 | 9/2001 | DeSouza | |
| 6,301,854 | B1 | 10/2001 | Daudet et al. | |
| 6,315,137 | B1 | 11/2001 | Mulford | |
| 6,418,695 | B1 | 7/2002 | Daudet | |
| D463,575 | S | 9/2002 | Daudet | |
| 6,578,335 | B2 | 6/2003 | Poliquin | |
| 6,644,603 | B2 | 11/2003 | Bailleux | |
| 6,662,520 | B1 | 12/2003 | Nelson | |
| 6,688,069 | B2 | 2/2004 | Zadeh | |
| 6,694,695 | B2 | 2/2004 | Collins | |
| 6,701,689 | B2 | 3/2004 | diGirolamo | |
| 6,702,270 | B1 | 3/2004 | Reschke | |
| 6,708,460 | B1 | 3/2004 | Elderson | |
| 6,739,562 | B2 * | 5/2004 | Rice | 248/247 |
| 6,792,733 | B2 | 9/2004 | Wheeler | |
| 6,920,734 | B2 | 7/2005 | Elderson | |
| 7,017,310 | B2 | 3/2006 | Brunt | |
| 7,021,021 | B2 | 4/2006 | Saldana | |
| 7,104,024 | B1 | 9/2006 | diGirolamo et al. | |
| 7,159,369 | B2 | 1/2007 | Elderson | |
| 7,168,219 | B2 | 1/2007 | Elderson | |
| 7,174,690 | B2 | 2/2007 | Zadeh | |
| D558,039 | S | 12/2007 | Skinner | |
| D573,873 | S | 7/2008 | Wall | |
| 7,398,621 | B2 | 7/2008 | Banta | |
| 7,503,150 | B1 | 3/2009 | diGirolamo | |
| 7,520,100 | B1 | 4/2009 | Herrman | |
| 7,559,519 | B1 | 7/2009 | Dragic | |
| 7,596,921 | B1 | 10/2009 | diGirolamo | |
| 7,634,889 | B1 | 12/2009 | diGirolamo et al. | |
| 7,739,850 | B2 | 6/2010 | Daudet | |
| 7,836,657 | B1 | 11/2010 | diGirolamo | |
| 7,913,472 | B2 * | 3/2011 | Troth et al. | 52/696 |
| 7,955,027 | B2 | 6/2011 | Nourian et al. | |
| 8,011,160 | B2 | 9/2011 | Rice | |
| D648,249 | S | 11/2011 | Noble et al. | |
| 8,083,187 | B2 | 12/2011 | Bernard et al. | |
| D657,891 | S | 4/2012 | Jones | |
| 8,167,250 | B2 | 5/2012 | White | |
| 8,205,402 | B1 | 6/2012 | diGirolamo | |
| 8,225,581 | B2 | 7/2012 | Strickland et al. | |
| D667,249 | S | 9/2012 | London | |
| D667,718 | S | 9/2012 | Preda | |
| 8,387,321 | B2 | 3/2013 | diGirolamo et al. | |
| 2002/0059773 | A1 | 5/2002 | Elderson | |
| 2003/0037494 | A1 | 2/2003 | Collins | |
| 2003/0089053 | A1 | 5/2003 | Elderson | |
| 2003/0145537 | A1 | 8/2003 | Bailey | |
| 2003/0167722 | A1 | 9/2003 | Klein et al. | |
| 2004/0079044 | A1 * | 4/2004 | Troth et al. | 52/696 |
| 2007/0251186 | A1 | 11/2007 | Rice | |
| 2010/0126103 | A1 | 5/2010 | diGirolamo et al. | |
| 2011/0154770 | A1 | 6/2011 | Friis | |
| 2013/0104490 | A1 | 5/2013 | Daudet et al. | |

OTHER PUBLICATIONS

Bailey Metal Products, "Bailey Bridgelock Bridging System (BL 365/400, BL 600, BL 800)", Mar. 2011, url: www.bmp-group.com, Bailey Metal Products Limited, Canada.

Clark Dietrich, "Clip Express Product Catalog", Pub. No. CD-Clip Express, Apr. 2012, pp. 40-44, 75-78, 100, cover and back, Clark Dietrich Building Systems LLC, Ohio, USA.

Marinoware, "FrameRite Connectors Product Catalog", pp. 11, cover and back, Oct. 2013, Ware Industries, Inc., USA.

SCAFCO, "MA-Multi-Use Secure Clip Catalog No. 200", pp. 24-25, cover and back, Apr. 2013, SCAFCO Steel Stud Company, USA.

TSN, "Light Steel Framing Connections: Custom Connectors & Clip Angles Catalog", pp. cover, 75-76, Nov. 2013, The Steel Network, Inc., USA.

Simpson Strong-Tie, "Wood Construction Connectors Catalog, C-2009", pp. 163-164, cover and back, 2009-2010, Simpson Strong-Tie Company, Inc., USA.

"Bridging, Bracing & Backing: Spazzer 5400 Spacer Bar (SPZS), Bar Guard (SPBG) & Grommet (SPGR)". Clip Express Product Catalog: Clips, Connectors, Framing Hardware, Apr. 2012, p. 77. Clark Dietrich Building Systems, USA.

"Metal-Lite Products". Metal Lite website, metal-lite.net. Accessed Sep. 20, 2013, one page. Metal Lite 2012, USA.

"Mantisgrip Product Catalog 2012". Catalog, 2012, 10 pages and cover. Mantisgrip 2012, USA.

"Wall Bridging Detail". NuconSteel Product Catalog, 2003, front cover, table of contents, p. 34. NuconSteel, USA.

"Double Deep-Leg Track", "Bridge Clip Installation", "BC600 & BC800 Installation", "BridgeBar", "BridgeClip", "BC600 or BC800". The Steel Network, Inc. Product Catalog, Jan. 2004, front cover, p. 11, 27, 49. Steel Network, Inc., USA.

"Framing Angles & Plates: LTP4/LTP5/A34/A35", Simpson Strong-Tie Wood Construction Connectors Catalog, C-2011, front cover and p. 180, 2011-2012, Simpson Strong-Tie Company, Inc., USA.

* cited by examiner

STEEL FRAMING CLIP

BACKGROUND OF THE INVENTION

The present invention relates to steel stud building wall systems and especially to apparatuses for stabilizing steed studs to prevent lateral movement and torsion in such systems.

Many industrial, and a growing number of residential, buildings are constructed with steel stud wall framing for a variety of reasons. Steel framing is fireproof, does not warp, cannot be infested, and does not rot. When a wall is built with any kind of stud, wood or steel, it is generally desirable to fix sequential studs relative to each other and each against lateral movement and torsion. In wood-stud walls, a short piece of wood blocking is typically nailed to adjacent stud pairs to stabilize them. In steel-stud walls, an elongated steel bridging member is typically inserted horizontally through pre-punched openings in a series of vertical studs to keep them aligned. Steel studs have excellent columnar strength when they are straight, but a significant portion of that strength is lost if the studs are twisted. Because steel studs are particularly vulnerable to torsion, the bridging member, which is typically channel-shaped, having a horizontal web and two vertical side flanges, is made to closely fit the openings in the vertical studs in order to maximize torque resistance. In additional to mechanical torque, metal studs can twist or bend in response to the heat of a fire when the drywall sheathing, which acts as a firebreak, is destroyed. When metal studs twist or bend, they lose their weight-bearing capacity, multiplying the damage caused directly by fire.

While channel-shaped bridging members closely received in the openings can help restrain the studs from twisting, some twisting can still occur and the studs can still shift or bend parallel to the wall. A variety of sheet metal brackets have been designed to prevent this shifting or bending. The prior art brackets are either simple L-brackets that are not specifically adapted for any particular connection or brackets that can only be used for a single type of connection, in this case the connection of bridging members to wall studs. The simple L-brackets form relatively weak connections and the others are limited in their utility. Neither is optimized for material saving and the ability to produce similar brackets of differing sizes on the same progressive die equipment with minimal changes.

It is an object of the present invention to provide a bracket that uses less material than prior art brackets, can be made in different widths on the same progressive die machinery with minimal equipment changes, and can be used to create a variety of connections in addition to one between wall studs and the bridging members that interconnect the wall studs for strength and stability.

SUMMARY OF THE INVENTION

The present invention provides a multipurpose connector that minimally occludes the opening in a conventional steel wall stud when used to connect a conventional bridging member to the wall stud, conserving the opening's function as a pass-through for pipes, conduits and wiring.

The present invention provides a multipurpose connector that has a tapering extension on one flange that maximizes its interface with a bridging member, and a matching central portion on the other flange that minimizes material waste when the connectors are cut from a roll of sheet metal on a progressive die machine.

The present invention provides a multipurpose connector that has a pair of tapering tabs that maximize the functional interface with a wall stud and maximize the functional size of the opening in the wall stud.

The present invention provides a multipurpose connector that has a plurality of fastener openings designed to permit a variety of secure connections to be made with the same fastener and a plurality of fasteners.

The present invention provides a plurality of multipurpose connectors of different widths that can all be made on the same progressive die production line with minimal setup changes.

DETAILED DESCRIPTION OF THE INVENTION

Figure 1:
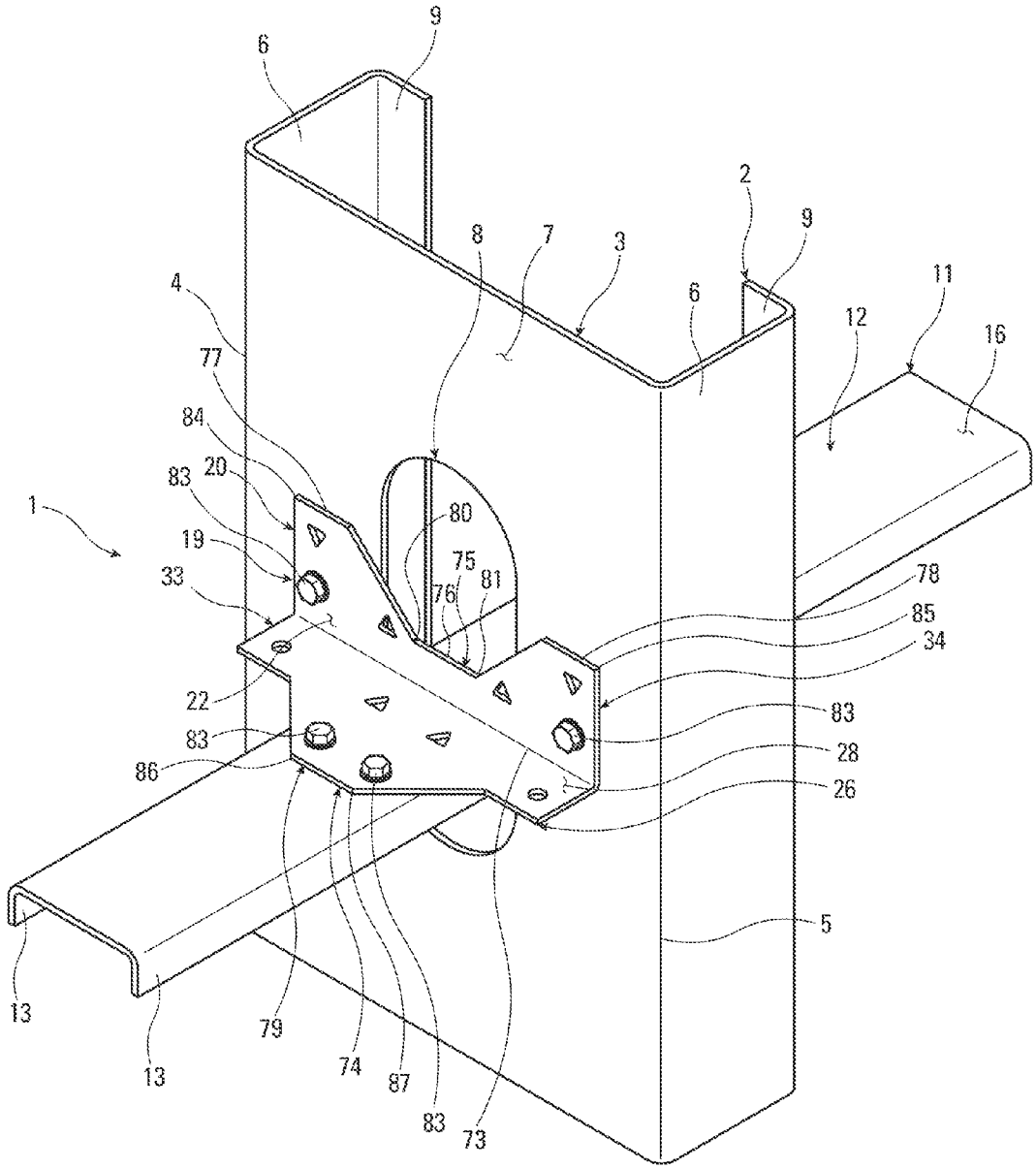
FIG. 1 is an upper front right perspective view of a connection made between a typical cold-formed steel wall stud, a typical cold-formed steel bridging member, and a bridging connector formed according to the present invention.

As seen in FIGS. 1-4, the present invention is a building connection 1 formed between a first elongated structural member 2 and a second elongated structural member 11 using a connector 19. The connector preferably is fastened to the first elongated structural member 2 and to the second elongated structural member 11. Preferably, the first elongated structural member 2 is a substantially vertical wall stud 2 in a building. The second elongated structural member 11 preferably is a substantially horizontal bridging member 11 used to stabilize adjacent wall studs 2.

Figure 2:
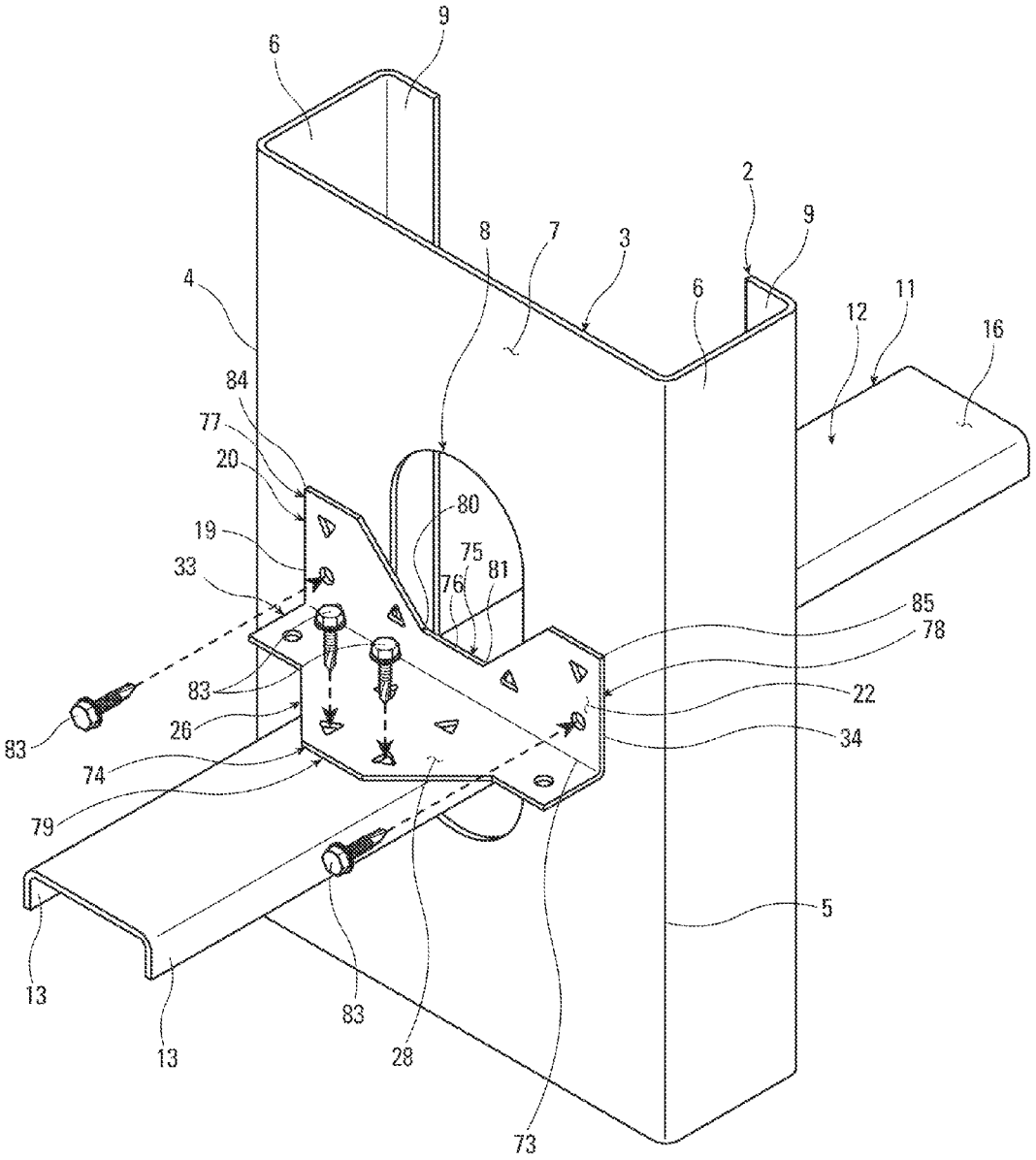
FIG. 2 is an upper front right perspective view of a bridging connector formed according to the present invention before the fasteners are used to attach the bridging connector to a typical cold-formed steel wall stud and a typical cold-formed steel bridging member.
Figure 3:
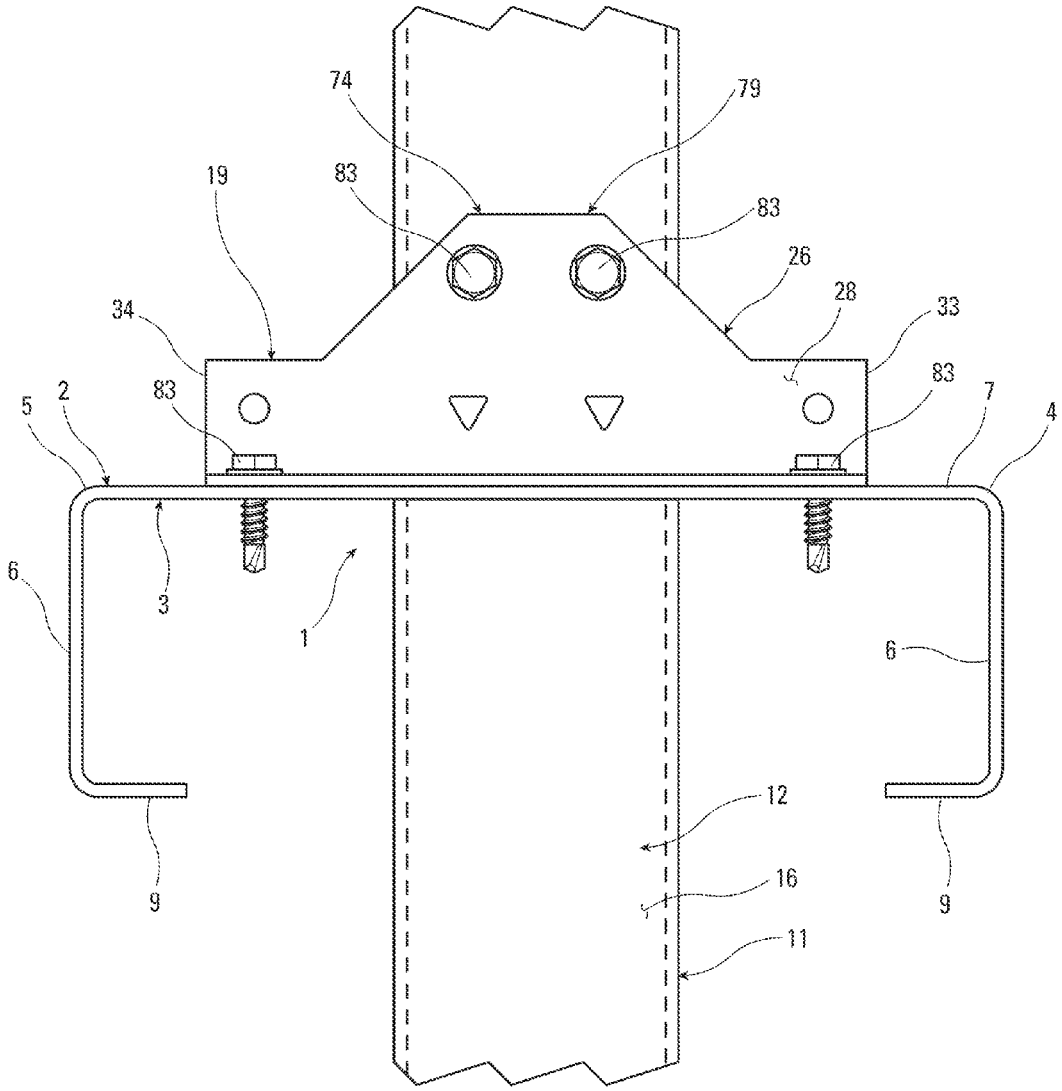
FIG. 3 is a top plan view of a connection made between a typical cold-formed steel wall stud, a typical cold-formed steel bridging member, and a preferred form of the bridging connector of the present invention outside the steel wall stud channel.
Figure 4:
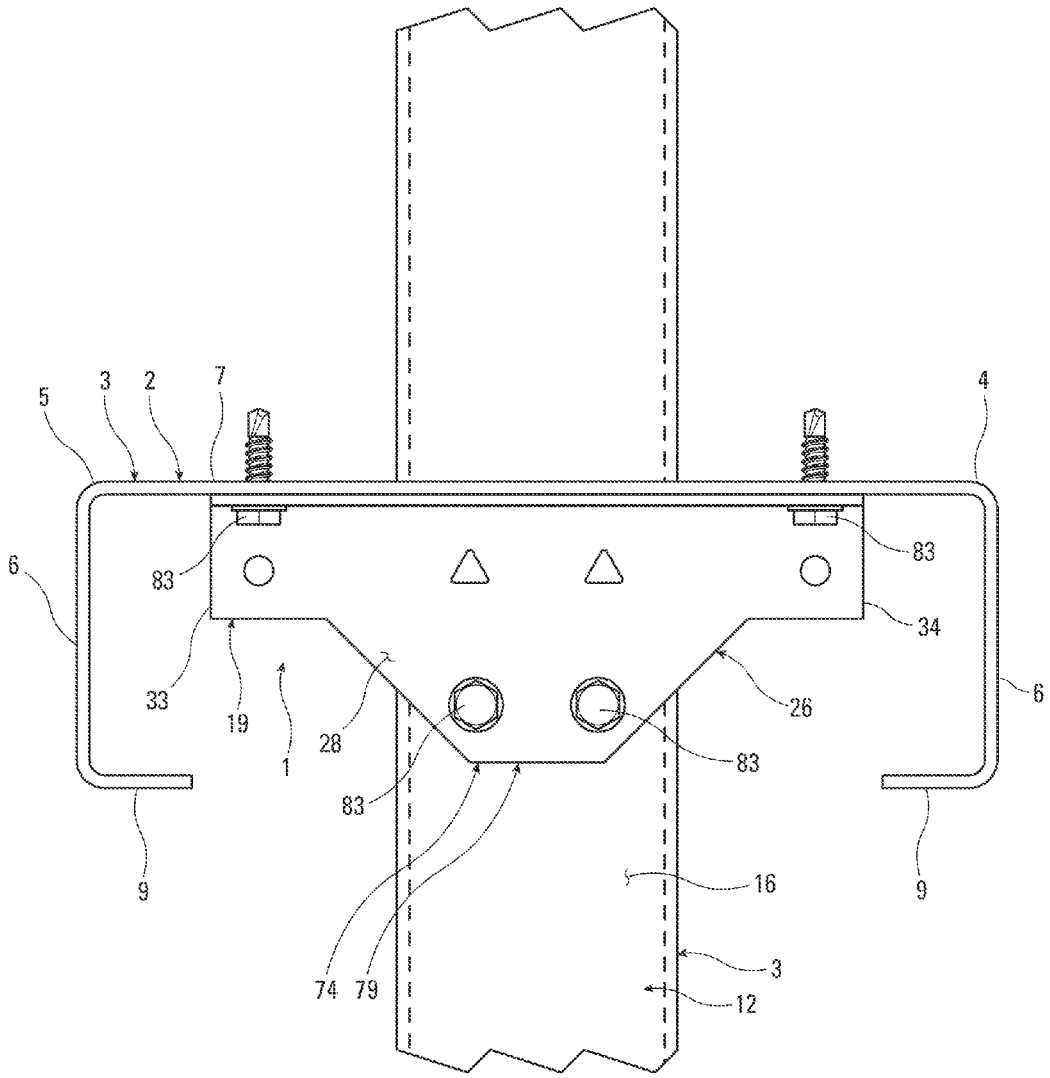
FIG. 4 is a top plan view of a connection made between a typical cold-formed steel wall stud, a typical cold-formed steel bridging member, and a preferred form of the bridging connector of the present invention inside the steel wall stud channel.
Figure 5:
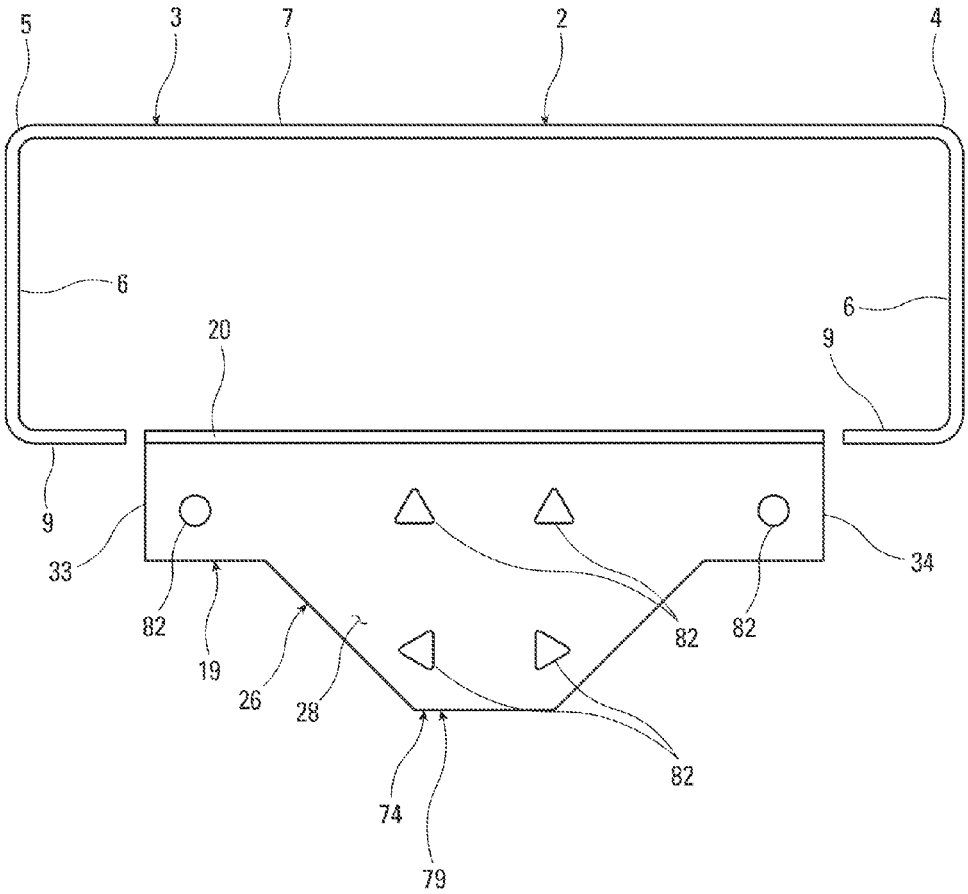
FIG. 5 is a top plan view of a typical cold-formed steel wall stud, and a preferred form of the bridging connector of the present invention showing how the bridging connector fits within the steel wall stud.
Figure 6:
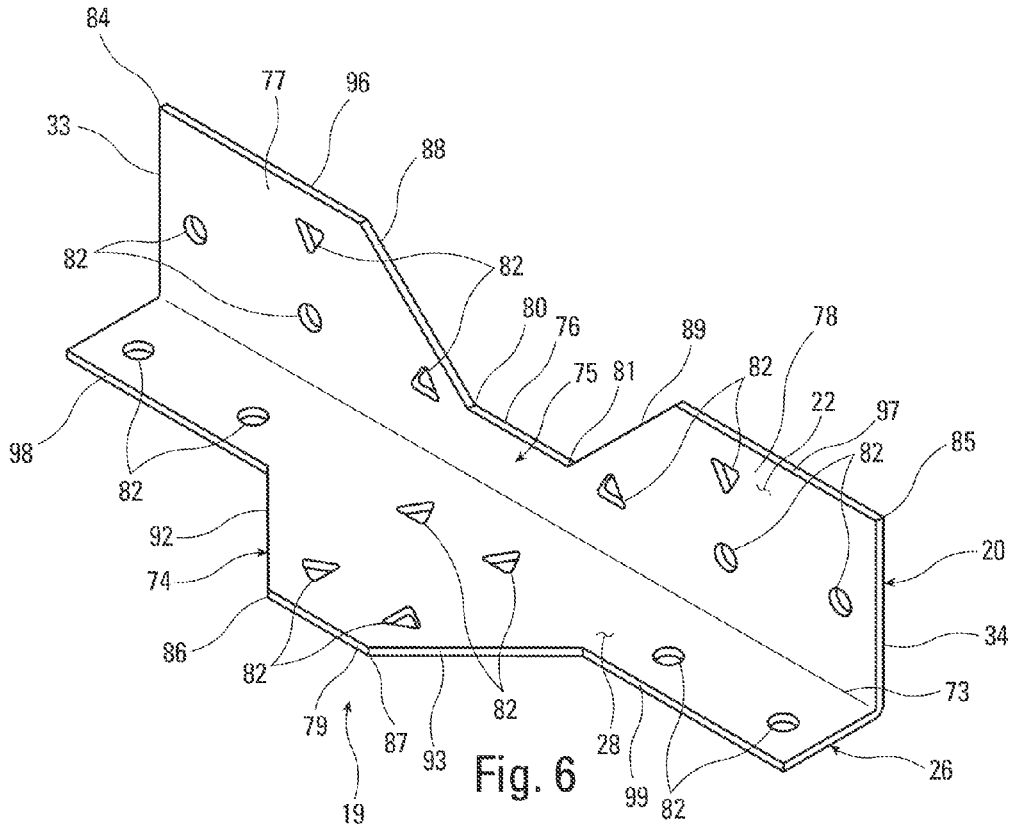
FIG. 6 is an upper front right perspective view of an alternate preferred embodiment of the connector of the present invention.
Figure 7:
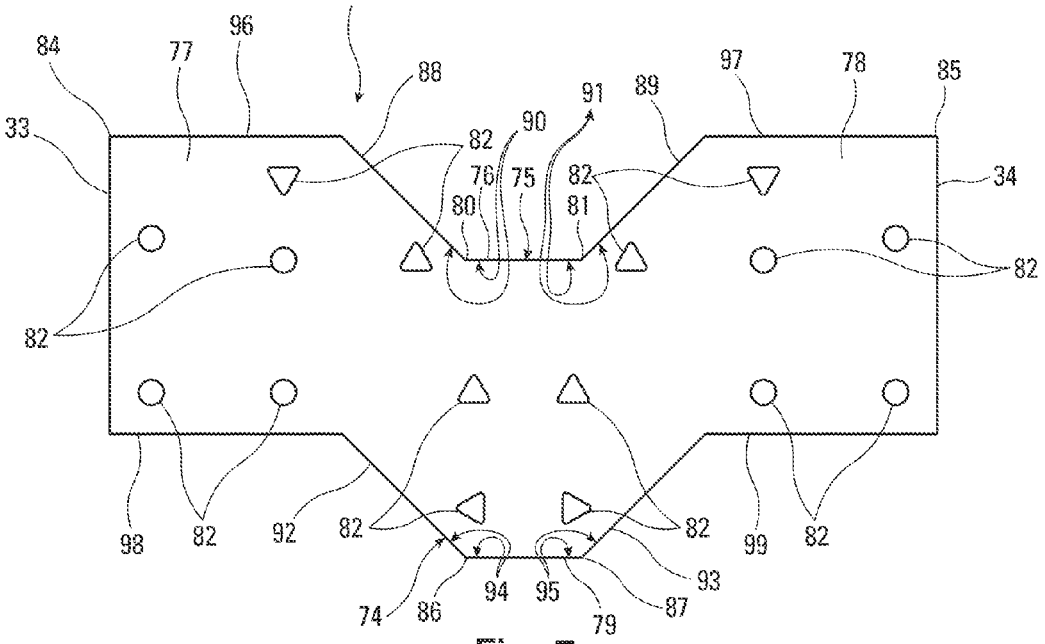
FIG. 7 is a top plan view of the unbent blank of the alternate preferred embodiment of the connector of the present invention shown in FIG. 6.
Figure 8:
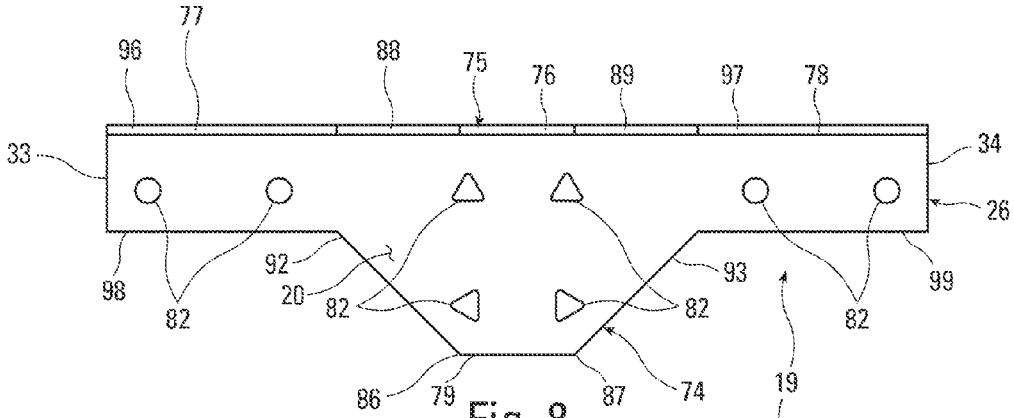
FIG. 8 is a top plan view of the alternate preferred embodiment of the connector of the present invention shown in FIG. 6.
Figure 9:
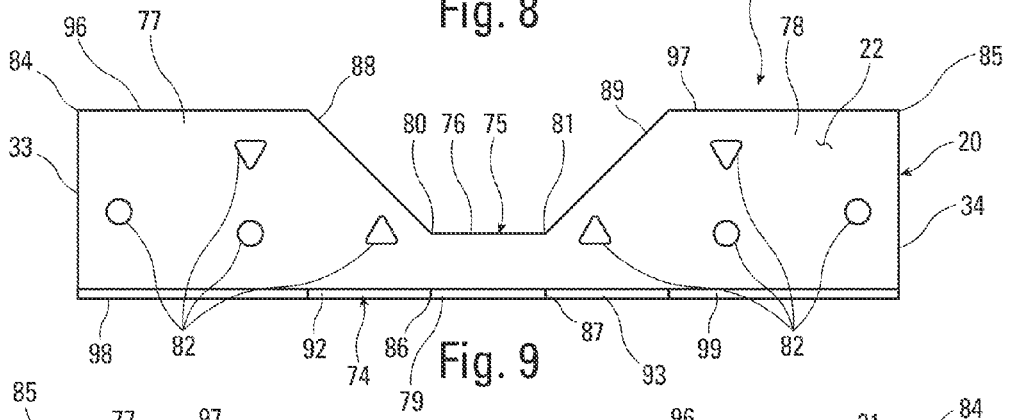
FIG. 9 is a front elevation view of the alternate preferred embodiment of the connector of the present invention shown in FIG. 6.
Figure 10:
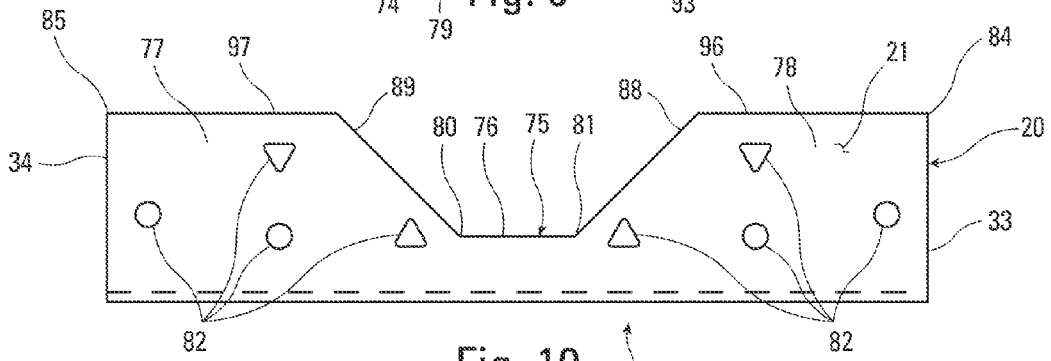
FIG. 10 is a rear elevation view of the alternate preferred embodiment of the connector of the present invention shown in FIG. 6.
Figure 11:
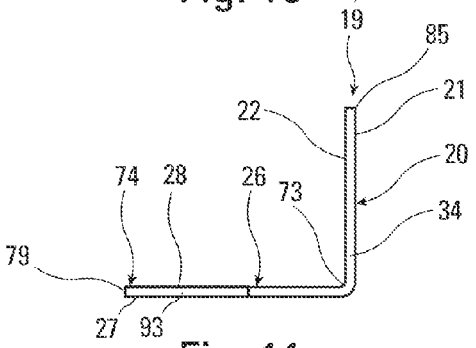
FIG. 11 is a right side elevation view of the alternate preferred embodiment of the connector of the present invention shown in FIG. 6.
Figure 12:
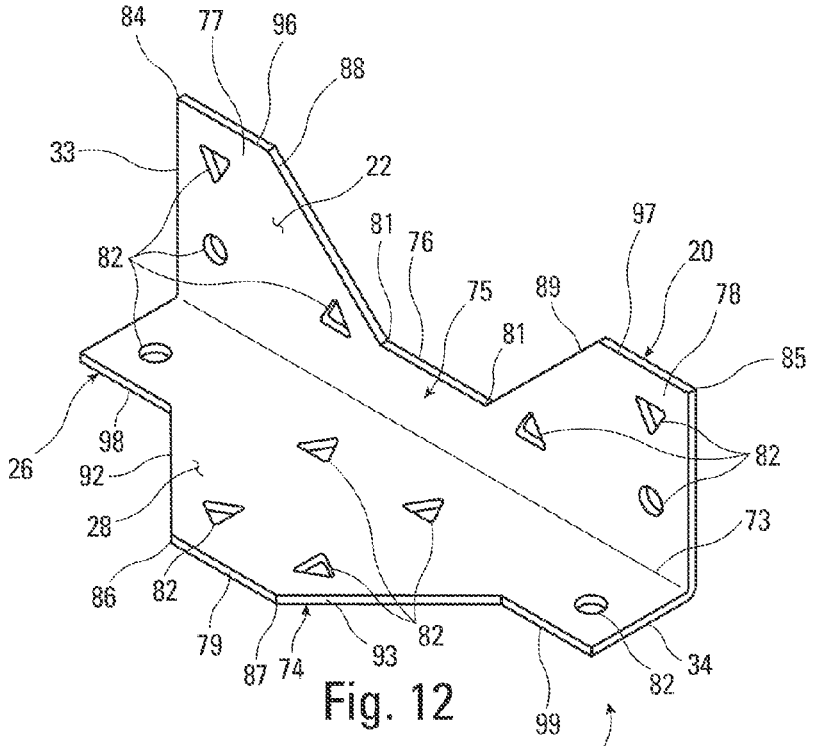
FIG. 12 is an upper front right perspective view of the preferred embodiment of the connector of the present invention shown in FIGS. 1-5.
Figure 13:
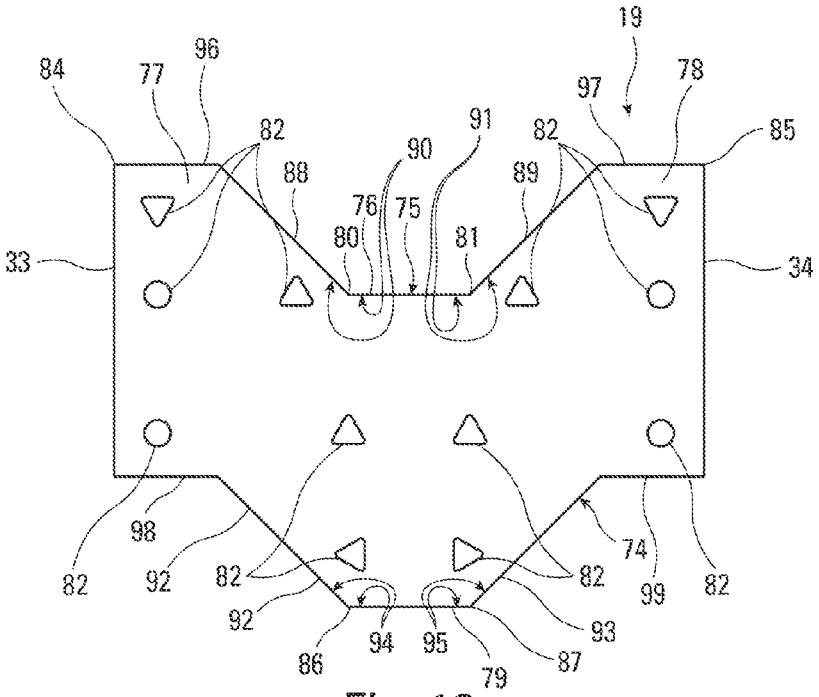
FIG. 13 is a top plan view of the unbent blank of the preferred embodiment of the connector of the present invention shown in FIG. 12.
Figure 14:
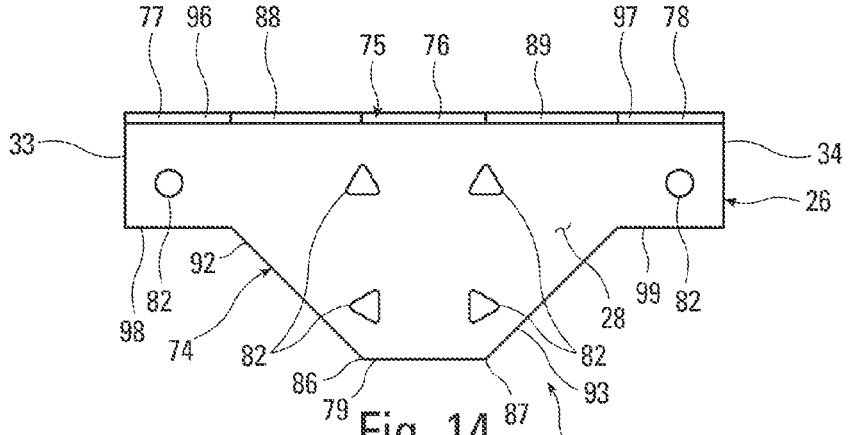
FIG. 14 is a top plan view of the preferred embodiment of the connector of the present invention shown in FIG. 12.
Figure 15:
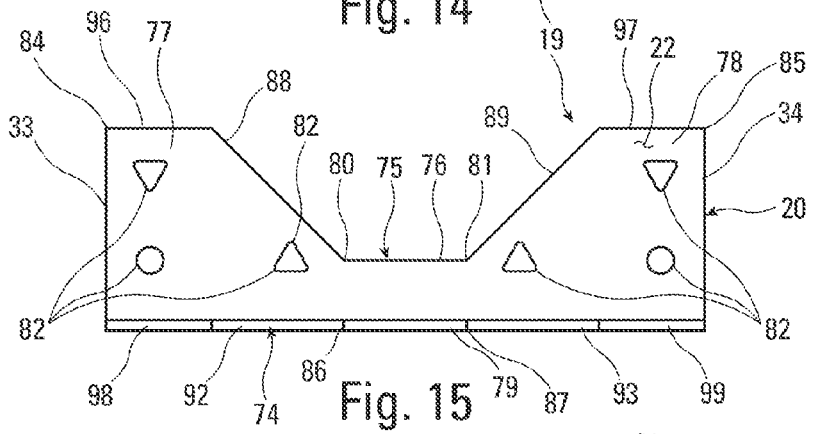
FIG. 15 is a front elevation view of the preferred embodiment of the connector of the present invention shown in FIG. 12.
Figure 16:
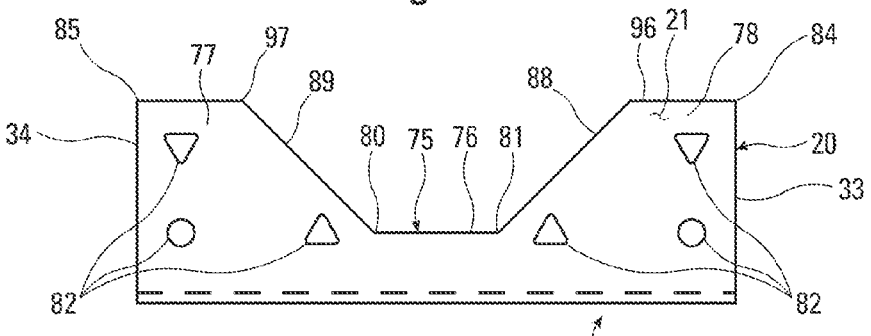
FIG. 16 is a rear elevation view of the preferred embodiment of the connector of the present invention shown in FIG. 12.
Figure 17:
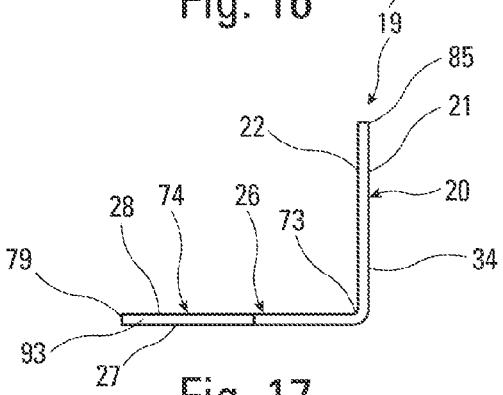
FIG. 17 is a right side elevation view of the preferred embodiment of the connector of the present invention shown in FIG. 12.
Figure 18:
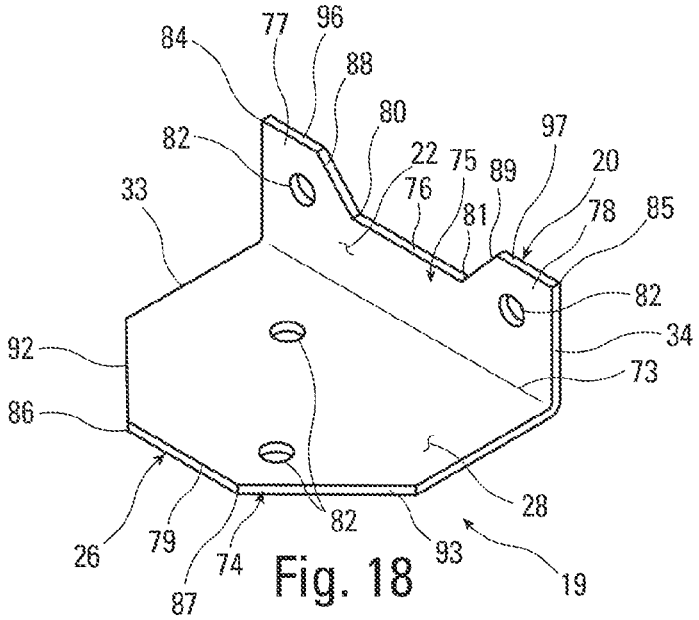
FIG. 18 is an upper front right perspective view of an alternate preferred embodiment of the connector of the present invention.
Figure 19:
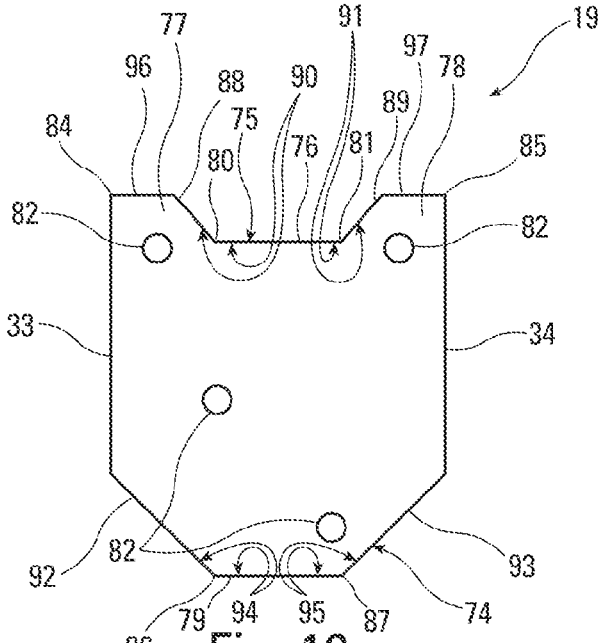
FIG. 19 is a top plan view of the unbent blank of the alternate preferred embodiment of the connector of the present invention shown in FIG. 6.
Figure 20:
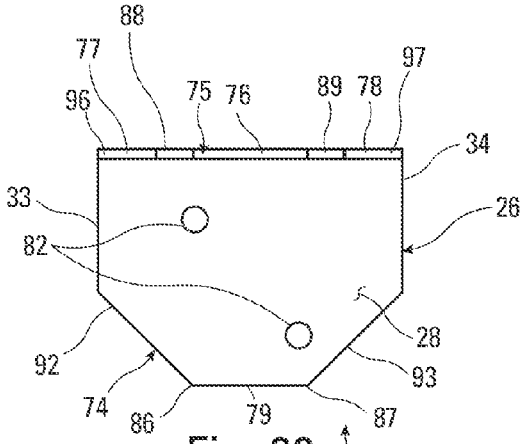
FIG. 20 is a top plan view of the alternate preferred embodiment of the connector of the present invention shown in FIG. 6.
Figure 21:
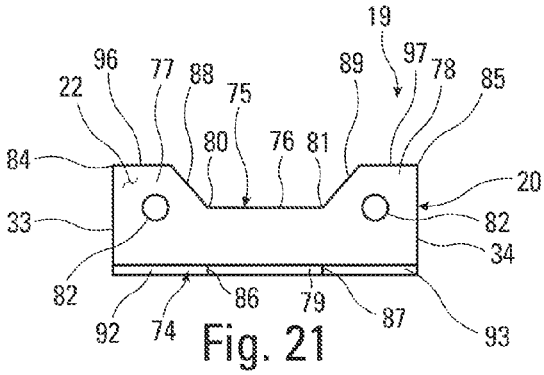
FIG. 21 is a front elevation view of the alternate preferred embodiment of the connector of the present invention shown in FIG. 6.
Figure 22:
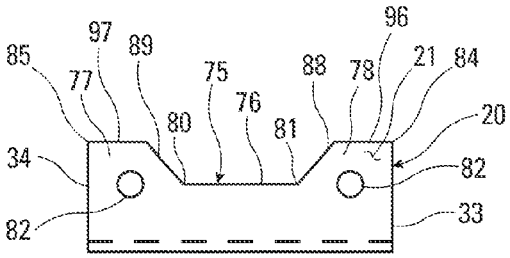
FIG. 22 is a rear elevation view of the alternate preferred embodiment of the connector of the present invention shown in FIG. 6.
Figure 23:
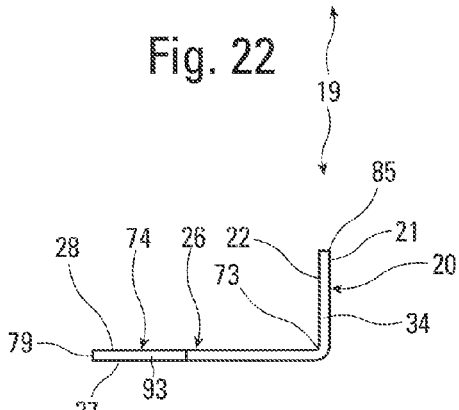
FIG. 23 is a right side elevation view of the alternate preferred embodiment of the connector of the present invention shown in FIG. 6.

As seen in FIGS. 1 and 2, preferably the first elongated structural member 2 has a first opening 8 in a first elongated outer surface 7 between a first elongated side 4 and a second elongated side 5. The second elongated structural member 11 preferably is substantially orthogonal to the first elongated structural member 2 and passes through the first opening 8 in the first elongated structural member 2. Preferably, the second elongated structural member 11 has a first elongated external surface 16.

The connector 19 preferably has a first flange 20 joined to a second flange 26 at a first angular juncture 73. Preferably, a first side edge 33 and a second side edge 34 bridge the first angular juncture 73. A first portion of the first side edge 33 and a first portion of the second side edge 34 preferably are on the first flange 20, and a second portion of the first side edge 33 and a second portion of the second side edge 34 are on the second flange 26.

Preferably, the first flange 20 has a first exterior surface 21 facing the first elongated outer surface 7 of the first elongated structural member 2. The second flange 26 preferably has a second exterior surface 27 facing the first elongated external surface 16 of the second elongated structural member 11. Preferably, the first flange 20 includes a central portion 75 with a first outer edge 76 that is disposed away from the first angular juncture 73. The first flange preferably has a first projecting tab 77 along the portion of the first side edge 33 on the first flange 20 and a second projecting tab 78 along the portion of the second side edge 34 on the first flange 20. Preferably, the first projecting tab 77 and the second projecting tab 78 project further away from the first angular juncture 73 than the first outer edge 76. The second flange 26 preferably has a first extension 74 that projects further from the first angular juncture 73 than any portion of the first side edge 33 on the second flange 26 and any portion of the second side edge 34 on the second flange 26.

As seen in FIGS. 1-4, preferably the first projecting tab 77 is fastened to the first elongated structural member 2 between the first elongated side 4 and the first opening 8. The second projecting tab 78 preferably is fastened to the first elongated structural member 2 between the second elongated side 5 and the first opening 8. Preferably, the central portion 75 at least partially overlaps the first opening 8 without projecting as far from the first angular juncture 73 as the first projecting tab 77 and the second projecting tab 78. The first opening 8 preferably is less occluded than if the central portion 75 projected as far from the first angular juncture 73 as either the first projecting tab 77 or the second projecting tab 78. Preferably, the second flange 26 is fastened to the second elongated structural member 11.

Preferably, the first extension 74 has a second outer edge 79 disposed away from the first angular juncture 73.

The first outer edge 76 of the central portion 75 of the first flange 20 and the second outer edge 79 of the first extension 74 of the second flange 26 preferably are parallel to the first angular juncture 73.

Preferably, the first outer edge 76 is the same length as the second outer edge 79. The first angular juncture 73 preferably is longer than the first outer edge 76 and the second outer edge 79.

Preferably, the first side edge 33 has a first distal end 84 on the first flange 20 disposed away from the first angular juncture 73. The second side edge 34 preferably has a second distal end 85 on the first flange 20 disposed away from the first angular juncture 73. Preferably, the first outer edge 76 of the central portion 75 of the first flange 20 has a first end 80 and a second end 81. The first end 80 and the second end 81 preferably are between the first side edge 33 and the second side edge 34. Preferably, the first flange 20 narrows between the first end 80 of the first outer edge 76 and the first distal end 84 of the first side edge 33. The first flange 20 preferably narrows between the second end 81 of the first outer edge 76 and the second distal end 85 of the second side edge 34. In other words, the first flange 20 on either side of the first outer edge 76 beyond the central portion 75 as the first flange 20 projects away from the first angular juncture 73.

Preferably, the second outer edge 79 of the first extension 74 of the second flange 26 has a first end 86 and a second end 87. The first end 86 and the second end 87 preferably are not between the first side edge 33 and the second side edge 34. Preferably, the second flange 26 widens between the first end 86 of the second outer edge 79 and the intersection of the first angular juncture 73 and the first side edge 33. The second flange 26 preferably widens between the second end 87 of the second outer edge 79 and the intersection of the first angular juncture 73 and the second side edge 34. In other words, the first extension 74 is narrowest at its second outer edge 79 and widens toward the first angular juncture 73. In addition, the second flange 26 can flare or further widen between the first extension 74 and the first angular juncture 73.

Preferably, the first outer edge 76 of the central portion 75 of the first flange 20 is joined to the first side edge 33 at least in part by a first angled side 88 that joins the first end 80 of the first outer edge 76 at a first reflex angle 90 less than 270 degrees as measured from within the first flange 20. The first outer edge 76 preferably is joined to the second side edge 34 at least in part by a second angled side 89 that joins the second end 81 of the first outer edge 76 at a second reflex angle 91 less than 270 degrees as measured from within the first flange 20.

Preferably, the second outer edge 79 of the first extension 74 of the second flange 26 is joined to the first side edge 33 at least in part by a third angled side 92 that joins the first end 86 of the second outer edge 79 at a first obtuse angle 94 as measured from within the second flange 26. The second outer edge 79 preferably is joined to the second side edge 34 at least in part by a fourth angled side 93 that joins the second end 87 of the second outer edge 79 at a second obtuse angle 95 as measured from within the second flange 26.

Preferably, the first reflex angle 90 and the first obtuse angle 94 are complementary, and the second reflex angle 91 and the second obtuse angle 95 are also complementary.

As seen in FIGS. 1-4, the first elongated structural member 2 preferably is a substantially vertical wall stud 2, and the second elongated structural member 11 is a substantially horizontal bridging member 11. The standard metal wall stud 2 is a C-channel made from sheet steel, with a first elongated web 3 with a first elongated side 4 and a second elongated side 5, a pair of parallel elongated side members 6 orthogonally joined to the first and second elongated sides 4 and 5, and a pair of smaller elongated reinforcing flanges 9 orthogonally joined to the first and second side members 6 so that the reinforcing flanges 9 are in the same plane and are parallel to the first elongated web 3. The standard metal bridging member 11 is an inverted U-channel also made from sheet metal, with a second elongated web 12, reinforced by a pair of bridging flanges 13 orthogonally joined to either side of the second elongated web 12.

Preferably, the first angled side 88 is joined to the first side edge 33 by a first connecting side 96, and the second angled side 89 is joined to the second side edge 34 by a second connecting side 97.

The third angled side 92 preferably is joined to the first side edge 33 by a third connecting side 98, and the fourth angled side 93 is joined to the second side edge 34 by a fourth connecting side 99

Preferably, the first angular juncture 73, the first outer edge 76, the second outer edge 79, the first angled side 88, the second angled side 89, the third angled side 92, the fourth angled side 93, first connecting side 96, the second connecting side 97, the third connecting side 98 and the fourth connecting side 99 are all straight.

The substantially vertical wall stud 2 preferably is made of metal, and the substantially horizontal bridging member 11 is made of metal. The connector 19 is particularly adapted for use with standard cold-formed steel structural members.

Preferably, the first extension 74 of the second flange 26 is fastened to the second elongated structural member 11. The added length of the first extension 74 allows the fasteners 83 to be placed as far away from the first angular juncture 73 as possible, which makes the resulting connection 1 stronger.

The first flange 20 and the second flange 26 each preferably have at least two fastener openings 82. In particular, the preferred connection 1 between a substantially vertical wall stud 2 and a substantially horizontal bridging member 11 is best made with two fasteners 83 in each of the connected structural members 2 and 11.

Preferably, the first connector 19 is fastened to the first elongated structural member 11 and the second elongated structural member 11 with separate fasteners 83. Most preferably, the separate fasteners 83 are self-drilling sheet metal screws 81 that cut their own holes through the connected structural members 2 and 11.

As seen in FIGS. 1-4 the first flange 20 and the second flange 26 each preferably have at least one fastener opening 82 that is unused and specifically adapted for correctly positioning one or more fasteners 83 in an alternate building connection. Although the connectors 19 are particularly adapted for making a connection 1 between a C-channel metal wall 2 stud and a U-channel metal bridging member 11, they gain added utility by being designed for other connections 1, especially between cold-formed steel structural members.

As seen in FIGS. 1-4, preferably the first flange 20 has a first interior surface 22 facing away from the first elongated structural member 2. The second flange 26 preferably has a second interior surface 28 facing away from the second elongated structural member 11. Preferably, the first angular juncture 73 is ninety degrees between the first interior surface 22 and the second interior surface 28. The connectors 19 as shown in all the drawing figures are adapted for making right-angled connections 1, especially the connection 1 between a substantially vertical wall stud 2 and a substantially horizontal bridging member 11.

As seen in FIGS. 6-23, in any given plurality of the connectors 19, each preferably has a first flange 20 joined to a second flange 26 at a first angular juncture 73, a first side edge 33 that bridges the first angular juncture 73 and a second side edge 34 that bridges the first angular juncture 73, such that a first portion of the first side edge 33 and a first portion of the second side edge 34 are on the first flange 20, and a second portion of the first side edge 33 and a second portion of the second side edge 34 are on the second flange 26. Preferably, the first flange 20 of each has a first exterior surface 21. The second flange 26 of each preferably has a second exterior surface 27. Preferably, the first flange 20 of each includes a central portion 75 with a first outer edge 76 disposed away from the first angular juncture 73, a first projecting tab 77 along the portion of the first side edge 33 on the first flange 20 and a second projecting tab 78 along the portion of the second side edge 34 on the first flange 20, the first projecting tab 77 and the second projecting tab 78 projecting further away from the first angular juncture 73 than the first outer edge 76. The second flange 26 of each preferably has a first extension 74 that projects further from the first angular juncture 73 than any portion of the first side edge 33 on the second flange 26 and any portion of the second side edge 34 on the second flange 26. Preferably, the first side edge 33 and the second side edge 34 of at least one connector 19 of the plurality of connectors 19 are closer together than the first side edge 33 and the second side edge 34 of at least one other connector 19 of the plurality of connectors 19.

The connectors 19 of the present invention are designed to make a variety of connections 1 with connectors 19 of differing widths that can all be made on the same progressive die machinery with a minimum of changes necessary to make the different sizes of connectors 19. Changing the width of the sheet metal, which is centered on the die, changes the shape of the blank, shown in FIGS. 7, 13 and 19, by changing its width and the only modification necessary is changing the number and location of the fastener openings 82 that are punched in the sheet metal.

I claim:

1. A building connection (1) comprising:

a. a first elongated structural member (2) having a first opening (8) in a first elongated outer surface (7) between a first elongated side (4) and a second elongated side (5);

b. a second elongated structural member (11) substantially orthogonal to the first elongated structural member (2) and passing through the first opening (8) in the first elongated structural member (2), the second elongated structural member (11) having a first elongated external surface (16); and c. a first connector (19) fastened to the first elongated structural member (2) and to the second elongated structural member (11), the first connector (19) consisting of a substantially planar first flange (20) joined to a substantially planar second flange (26) at a first angular juncture (73), wherein all portions of the first connector (19) are part of either of the first and second substantially planar first and second flanges (20) and (26) and lie in a common plane with either the first or second substantially planar first and second flanges (20) and (26), a first side edge (33) that bridges the first angular juncture (73) and a second side edge (34) that bridges the first angular juncture (73), such that a first portion of the first side edge (33) and a first portion of the second side edge (34) are on the first flange (20), and a second portion of the first side edge (33) and a second portion of the second side edge (34) are on the second flange (26), wherein:

i. the first flange (20) has a first exterior surface (21) facing the first elongated outer surface (7) of the first elongated structural member (2);

ii. the second flange (26) has a second exterior surface (27) facing the first elongated external surface (16) of the second elongated structural member (11);

iii. the first flange (20) includes a central portion (75) with a first outer edge (76) disposed away from the first angular juncture (73), a first projecting tab (77) along the portion of the first side edge (33) on the first flange (20) and a second projecting tab (78) along the portion of the second side edge (34) on the first flange (20), the central portion (75), the first projecting tab (77), and the second projecting tab (78) all being disposed in substantially the same plane, the first projecting tab (77) and the second projecting tab (78) projecting further away from the first angular juncture (73) than the first outer edge (76) of the central portion (75); and iv. the second flange (26) has a first extension (74) that projects further from the first angular juncture (73) than any portion of the first side edge (33) on the second flange (26) and any portion of the second side edge (34) on the second flange (26), wherein:

(a) the first projecting tab (77) is fastened to the first elongated structural member (2) between the first elongated side (4) and the first opening (8);

(b) the second projecting tab (78) is fastened to the first elongated structural member (2) between the second elongated side (5) and the first opening (8);

(c) the central portion (75) at least partially overlaps the first opening (8) without projecting as far from the first angular juncture (73) as the first projecting tab (77) and the second projecting tab (78), such that the first opening (8) is less occluded; and (d) the second flange (26) is fastened to the second elongated structural member (11).

2. The building connection (1) of claim 1 wherein the first extension (74) has a second outer edge (79) disposed away from the first angular juncture (73).

3. The building connection (1) of claim 2 wherein the first outer edge (76) of the central portion (75) of the first flange (20) and the second outer edge (79) of the first extension (74) of the second flange (26) are parallel to the first angular juncture (73).

4. The building connection (1) of claim 3 wherein:

a. the first outer edge (76) of the central portion (75) of the first flange (20) is the same length as the second outer edge (79) of the first extension (74) of the second flange (26); and b. the first angular juncture (73) is longer than the first outer edge (76) and the second outer edge (79).

5. The building connection (1) of claim 4 wherein:

a. the first side edge (33) has a first distal end (84) on the first flange (20) disposed away from the first angular juncture (73);

b. the second side edge (34) has a second distal end (85) on the first flange (20) disposed away from the first angular juncture (73);

a. the first outer edge (76) of the central portion (75) of the first flange (20) has a first end (80) and a second end (81), the first end (80) and the second end (81) being between the first side edge (33) and the second side edge (34);

b. the first flange (20) narrows between the first end (80) of the first outer edge (76) and the first distal end (84) of the first side edge (33); and c. the first flange (20) narrows between the second end (81) of the first outer edge (76) and the second distal end (85) of the second side edge (34).

6. The building connection (1) of claim 5 wherein:

a. the second outer edge (79) of the first extension (74) of the second flange (26) has a first end (86) and a second end (87), the first end (86) and the second end (87) not being between the first side edge (33) and the second side edge (34);

b. the second flange (26) widens between the first end (86) of the second outer edge (79) and the intersection of the first angular juncture (73) and the first side edge (33); and c. the second flange (26) widens between the second end (87) of the second outer edge (79) and the intersection of the first angular juncture (73) and the second side edge (34).

7. The building connection (1) of claim 6 wherein:

a. the first outer edge (76) of the central portion (75) of the first flange (20) is joined to the first side edge (33) at least in part by a first angled side (88) that joins the first end (80) of the first outer edge (76) at a first reflex angle (90) less than 270 degrees as measured from within the first flange (20); and b. the first outer edge (76) is joined to the second side edge (34) at least in part by a second angled side (89) that joins the second end (81) of the first outer edge (76) at a second reflex angle (91) less than 270 degrees as measured from within the first flange (20).

8. The building connection (1) of claim 7 wherein:

a. the second outer edge (79) of the first extension (74) of the second flange (26) is joined to the first side edge (33) at least in part by a third angled side (92) that joins the first end (86) of the second outer edge (79) at a first obtuse angle (94) as measured from within the second flange (26); and b. the second outer edge (79) is joined to the second side edge (34) at least in part by a fourth angled side (93) that joins the second end (87) of the second outer edge (79) at a second obtuse angle (95) as measured from within the second flange (26).

9. The building connection (1) of claim 8 wherein:

a. the first reflex angle (90) and the first obtuse angle (94) are complementary; and b. the second reflex angle (91) and the second obtuse angle (95) are complementary.

10. The building connection (1) of claim 9 wherein:

a. the first angled side (88) is joined to the first side edge (33) by a first connecting side (96); and b. the second angled side (89) is joined to the second side edge (34) by a second connecting side (97).

11. The building connection (1) of claim 10 wherein:

a. the third angled side (92) is joined to the first side edge (33) by a third connecting side (98); and b. the fourth angled side (93) is joined to the second side edge (34) by a fourth connecting side (99).

12. The building connection (1) of claim 11 wherein:

a. the first angular juncture (73), the first outer edge (76) of the central portion (75) of the first flange (20), the second outer edge (79) of the first extension (74) of the second flange (26), the first angled side (88), the second angled side (89), the third angled side (92), the fourth angled side (93), first connecting side (96), the second connecting side (97), the third connecting side (98) and the fourth connecting side (99) are all straight.

13. The building connection (1) of claim 1 wherein:

a. the first elongated structural member (2) is a substantially vertical wall stud (2); and b. the second elongated structural member (11) is a substantially horizontal bridging member (11).

14. The building connection (1) of claim 13 wherein:

a. the substantially vertical wall stud (2) is made of metal;

b. the substantially horizontal bridging member (11) is made of metal.

15. The building connection (1) of claim 1 wherein:

a. the first flange (20) and the second flange (26) each have at least two fastener openings (82).

16. The building connection (1) of claim 1 wherein:

a. the first extension (74) of the second flange (26) is fastened to the second elongated structural member (11).

17. The building connection (1) of claim 16 wherein:

a. the first connector (19) is fastened to the first elongated structural member (11) and the second elongated structural member (11) with separate fasteners (83).

18. The building connection (1) of claim 17 wherein:

a. the first flange (20) and the second flange (26) each have at least one fastener opening (82) that is unused and specifically adapted for correctly positioning one or more fasteners (83) in an alternate building connection.

19. The building connection (1) of claim 1 wherein:

a. the first flange (20) has a first interior surface (22) facing away from the first elongated structural member (2);

b. the second flange (26) has a second interior surface (28) facing away from the second elongated structural member (11);

c. the first angular juncture (73) is ninety degrees between the first interior surface (22) and the second interior surface (28).

20. A plurality of differently dimensioned connectors (19), each having:

a. a substantially planar first flange (20) joined to a substantially planar second flange (26) at a first angular juncture (73), wherein all portions of the connectors (19) are part of either of the first and second substantially planar first and second flanges (20) and (26) and lie in a common plane with either the first or second substantially planar first and second flanges (20) and (26), a first side edge (33) that bridges the first angular juncture (73) and a second side edge (34) that bridges the first angular juncture (73), such that a first portion of the first side edge (33) and a first portion of the second side edge (34) are on the first flange (20), and a second portion of the first side edge (33) and a second portion of the second side edge (34) are on the second flange (26), wherein:

i. the first flange (20) has a first exterior surface (21);

ii. the second flange (26) has a second exterior surface (27);

iii. the first flange (20) includes a central portion (75) with a first outer edge (76) disposed away from the first angular juncture (73), a first projecting tab (77) along the portion of the first side edge (33) on the first flange (20) and a second projecting tab (78) along the portion of the second side edge (34) on the first flange (20), the central portion (75), the first projecting tab (77), and the second projecting tab (78) all being disposed in substantially the same plane, the first projecting tab (77) and the second projecting tab (78) projecting further away from the first angular juncture (73) than the first outer edge (76) of the central portion (75) of the first flange (20); and iv. the second flange (26) has a first extension (74) that projects further from the first angular juncture (73) than any portion of the first side edge (33) on the second flange (26) and any portion of the second side edge (34) on the second flange (26), wherein:

(a) the first side edge (33) and the second side edge (34) of at least one connector (19) of the plurality of connectors (19) are closer together than the first side edge (33) and the second side edge (34) of at least one other connector (19) of the plurality of connectors (19).

* * * * *